US011517955B2

(12) United States Patent
Breen et al.

(10) Patent No.: US 11,517,955 B2
(45) Date of Patent: Dec. 6, 2022

(54) TAPERED TRANSITION PILOT

(71) Applicant: STANDARD LIFTERS, INC., Grand Rapids, MI (US)

(72) Inventors: Scott M. Breen, Ada, MI (US); Joel T. Pyper, Holland, MI (US)

(73) Assignee: STANDARD LIFTERS, INC., Grand Rapids, MI (US)

( * ) Notice: Subject to any disclaimer, the term of this patent is extended or adjusted under 35 U.S.C. 154(b) by 406 days.

(21) Appl. No.: 16/658,192

(22) Filed: Oct. 21, 2019

(65) Prior Publication Data

US 2020/0122220 A1 Apr. 23, 2020

Related U.S. Application Data

(60) Provisional application No. 62/749,326, filed on Oct. 23, 2018.

(51) Int. Cl.

| | |
|---|---|
| ***B21D 43/00*** | (2006.01) |
| ***B21D 28/34*** | (2006.01) |
| ***B21D 37/08*** | (2006.01) |

(52) U.S. Cl.

CPC ..... *B21D 43/003* (2013.01); *B21D 28/34* (2013.01); *B21D 37/08* (2013.01)

(58) Field of Classification Search

CPC ..... B21D 28/04; B21D 28/34; B21D 28/265; B21D 37/08; B21D 39/031; B21D 43/003; B21D 45/006

See application file for complete search history.

(56) References Cited

U.S. PATENT DOCUMENTS

| | | | | |
|---|---|---|---|---|
| 2,168,377 | A | 8/1939 | Wales | |
| 3,335,627 | A | 8/1967 | Smelts et al. | |
| 3,336,627 | A | 8/1967 | Nemoede et al. | |
| 3,620,113 | A | 11/1971 | Gargrave | |
| 3,848,452 | A | 11/1974 | Gargrave | |
| 3,938,794 | A | 2/1976 | Stevens et al. | |
| 3,998,369 | A | 12/1976 | Grosjean et al. | |
| 4,118,968 | A | 10/1978 | Ames | |
| 4,171,656 | A * | 10/1979 | Gargrave | B21D 28/34 408/231 |
| 4,282,736 | A | 8/1981 | Mashburn | |
| 4,342,214 | A | 8/1982 | Neuendorf | |

(Continued)

FOREIGN PATENT DOCUMENTS

| | | |
|---|---|---|
| JP | 56084130 | 7/1981 |
| JP | 56122634 | 9/1981 |

(Continued)

OTHER PUBLICATIONS

Standard Lifters, Inc., "Pilot Assembly," sales brochure, Oct. 2011, 15 pages, Grand Rapids, Michigan.

(Continued)

*Primary Examiner* — Teresa M Ekiert
(74) *Attorney, Agent, or Firm* — Price Heneveld LLP

(57) ABSTRACT

A pilot assembly having a shaped portion and a shaped fastener relief for attachment to a die. The pilot assembly includes a fastener with a shaped washer that engages the shaped fastener relief to permit installation and removal of the pilot from the die. The shaped portion of the pilot assembly helps to locate and center the stock down the pilot assembly toward the die.

20 Claims, 6 Drawing Sheets

(56) References Cited

U.S. PATENT DOCUMENTS

| | | | | |
|---|---|---|---|---|
| 4,424,639 | A | 1/1984 | Richardson | |
| 4,457,196 | A | 7/1984 | Cady | |
| 4,516,449 | A | 5/1985 | Boyette | |
| 4,644,836 | A | 2/1987 | Wepner et al. | |
| 4,646,599 | A | 3/1987 | Benedict | |
| 4,916,931 | A | 4/1990 | Kaeseler | |
| 4,945,749 | A | 8/1990 | Walker et al. | |
| 4,993,295 | A | 2/1991 | Dacey, Jr. | |
| 5,359,914 | A | 11/1994 | Brown | |
| 5,722,280 | A | 3/1998 | Bodnar | |
| 5,860,315 | A | 1/1999 | Sawdon | |
| 7,581,475 | B2 | 9/2009 | Moelering | |
| 7,694,399 | B2 | 4/2010 | Sawdon et al. | |
| 8,844,335 | B2 | 9/2014 | Pyper et al. | |
| 8,950,233 | B2 | 2/2015 | Pyper et al. | |
| 8,955,364 | B2 | 2/2015 | Breen et al. | |
| 9,067,253 | B2 | 6/2015 | Pyper et al. | |
| 9,138,799 | B2 | 9/2015 | Breen et al. | |
| 9,289,815 | B2 | 3/2016 | Breen et al. | |
| 9,469,043 | B2 | 10/2016 | Sugizaki et al. | |
| 9,895,740 | B2 | 2/2018 | Breen et al. | |
| 2005/0241360 | A1 | 11/2005 | Miller et al. | |
| 2006/0193937 | A1 | 8/2006 | Gakovic | |
| 2009/0044671 | A1 | 2/2009 | Greenlead | |
| 2009/0193865 | A1 | 8/2009 | Pyper et al. | |
| 2011/0247467 | A1* | 10/2011 | Johnson | B21D 28/34 83/13 |
| 2013/0167612 | A1 | 7/2013 | Breen et al. | |
| 2013/0255350 | A1 | 10/2013 | Schneider et al. | |
| 2014/0144202 | A1 | 5/2014 | Pyper et al. | |
| 2015/0375292 | A1 | 12/2015 | Breen et al. | |
| 2016/0256913 | A1* | 9/2016 | Townsend | B21D 28/34 |

FOREIGN PATENT DOCUMENTS

| | | |
|---|---|---|
| JP | 57100825 | 6/1982 |
| JP | 06142788 | 5/1994 |
| KR | 1020010069897 | 7/2001 |
| KR | 1020060104028 | 10/2006 |
| KR | 100766072 | 10/2007 |
| RU | 1822811 | 6/1993 |
| SU | 389870 | 7/1973 |
| SU | 1061886 | 12/1983 |

OTHER PUBLICATIONS

Standard Lifters, Inc., "Pilot Sleeve," sales brochure, Jan. 2012, 18 pages, Grand Rapids, Michigan.

Fibro Inc., "Pilot Units to Daimler Standard," catalog, p. E72, date unknown, 1 page, Rockford, Illinois.

Dayton Progress Corporation, "Regular Pilots," catalog, pp. 9, 11, and 13, date unknown, 3 pages, Dayton, Ohio.

Ajacs Die Sales Corporation, Pilot Retainer, sales brochure, date unknown, 2 pages, Grand Rapids, Michigan.

Misumi Corporation, "Pilot Punches," catalog, pp. 202, 220, 228, 234, 242, 946, and 948, date unknown, 7 pages, Schaumburg, Illinois.

Modern Die Systems Inc., "Die Accessories," sales brochure, date unknown, 1 page, Ellwood, Indiana.

* cited by examiner

TAPERED TRANSITION PILOT

CROSS REFERENCE TO RELATED APPLICATION

Applicant hereby claims the priority benefits under the provisions of 35 U.S.C. § 119, basing said claim of priority on related U.S. Provisional Application No. 62/749,326 filed Oct. 23, 2018, which is incorporated in its entirety herein by reference.

BACKGROUND OF THE INVENTION

The present invention relates to metal forming dies and the like, and in particular to a pilot assembly and associated method.

Metal forming dies, such as stamping dies and the like, are well known in the art. Progressive metal forming dies are unique, very sophisticated mechanisms which have multiple stations or progressions that are aligned longitudinally, and are designed to perform a specified operation at each station in a predetermined sequence to create a finished metal part. Progressive stamping dies are capable of forming complex metal parts at very high speeds, so as to minimize manufacturing costs.

Heretofore, the dies used in metal forming processes have typically been individually designed, one of a kind assemblies for a particular part, with each of the various components being handcrafted and custom mounted or fitted in an associated die set, which is in turn positioned in a stamping press. Not only are the punches and the other forming tools in the die set individually designed and constructed, but the other parts of the die set, such as stock lifters, guides, end caps and keepers, cam returns, pilots, etc. are also custom designed, and installed in the die set. Current die making processes require carefully machined, precision holes and recesses in the die set for mounting the individual components, such that the same are quite labor intensive, and require substantial lead time to make, test, and set up in a stamping press. Consequently, such metal forming dies are very expensive to design, manufacture, and repair or modify.

The metal part can be accurately located in an individual working station by means of a previously formed hole on the part being placed over a pilot, which registers the part before the work is performed. The pilot is mounted in one of the die members and the part is presented to the pilot. The pilot usually has a shaped end that makes it easier to enter the formed hole on the part. Much of engagement into locating the hole in the part is dependent upon the work being performed in the tool. The part may need to be lifted prior to or after work is performed. The part is usually located on the pilot in the working position and potentially the lifted position as well. These pilots can be purchased as standard components or home-made by a shop.

The shaped end of the pilot that enters the formed hole in the metal part comes in many shapes, such as a short taper, long taper, acute-angle, bullet nose, parabolic point, spherical, and chamfered.

While such prior pilot assemblies have been successful, they are rather expensive and time-consuming to construct and install in an associated die set, such that further improvements and enhancements to the same, as well as metal forming dies generally, would be clearly advantageous and are disclosed herein.

SUMMARY OF THE INVENTION

One aspect of the present invention is a multi-station metal forming die having at least two mutually converging and diverging die members between which an elongate stock is shifted longitudinally to form parts from the stock incorporating a pilot assembly. The pilot assembly includes a pilot operably supported on one of the die members. The pilot has an outer end oriented toward the stock, an oppositely disposed inner end away from the stock, and a medial portion disposed axially between the outer and inner ends. The pilot has a generally cylindrical shaped shoulder portion disposed at the medial portion, having a first diameter. The pilot also has a generally cylindrically shaped body portion disposed at the inner end of the pilot that has a second diameter which is less than the first diameter of the shoulder portion. The difference in diameters forms a first annularly shaped, radially oriented shoulder therebetween. The pilot also has a generally tapered transition portion disposed at the outer end. The generally tapered transition portion includes a generally cylindrical innermost portion disposed adjacent to the generally cylindrically shaped shoulder portion of the pilot. The generally cylindrical innermost portion has a third diameter that is less than the first diameter of the shoulder portion to define a second annularly shaped, radially oriented shoulder therebetween for securing said pilot in an associated pilot mounting aperture in the die member. The generally tapered transition portion of the pilot also has a generally conically shaped outermost portion extending from a generally cylindrical portion, having a fourth diameter which is smaller than the third diameter. The generally tapered transition portion of the pilot also includes a tapered portion that tapers from the third diameter to the fourth diameter. The pilot assembly also includes at least one fastener relief formed in a portion of the generally cylindrically shaped shoulder portion of the pilot. The pilot assembly also includes at least one mounting fastener having an enlarged head portion that is at least partially received in the fastener relief, and a shank portion anchored in the die member to secure the pilot to the die member.

In another aspect of the present invention is a pilot assembly for a metal forming die in which a stock is formed into at least one part. The pilot assembly includes a pilot operably supported on a die. The pilot has an outer end oriented toward the stock, an operably disposed inner end oriented away from the stock. The pilot also includes a generally cylindrical shaped body portion disposed at the inner end. The pilot also has a generally tapered transition portion disposed at the outer end. The generally tapered transition portion includes a generally cylindrical innermost portion disposed adjacent to the generally cylindrically shaped body portion. The generally tapered transition portion also includes a generally pointed outermost portion. The generally tapered transition portion also includes a tapered portion extending between the generally cylindrical innermost portion to the stock of the pointed outermost portion. The pilot assembly also has at least one shaped fastener relief formed into a portion of the generally cylindrically shaped body portion of the pilot. The pilot assembly also includes at least one mounting fastener having an enlarged head portion, and a shank portion anchored in the die member to securely mount the pilot to the die member. The pilot assembly also includes at least one shaped washer that is recessed on the at least one mounting fastener to engage at least a portion of the shaped fastener relief.

Yet another aspect of the present invention is a pilot assembly for engaging a hole in a stock. The pilot assembly includes a pilot having an outer end oriented toward the stock, an oppositely disposed inner end oriented away from the stock, and a medial portion disposed axially between the outer and the inner ends. The pilot includes a generally cylindrically shaped shoulder portion disposed at the medial portion, having a first diameter. The pilot includes a generally cylindrically shaped body portion disposed at the inner end having a second diameter that is less than the first diameter of the shoulder portion to define a first annularly shaped, radially oriented shoulder therebetween. The pilot also includes a generally tapered transition portion disposed at the outer end. The generally tapered transition portion includes a generally cylindrical innermost portion disposed adjacent to the generally cylindrically shaped shoulder portion of the pilot, with a third diameter that is less than the first diameter of the shoulder portion, to define a second annularly shaped, radially oriented shoulder therebetween. The generally tapered transition portion also includes a generally conically shaped outermost portion extending from a generally cylindrical portion having a fourth diameter, which is smaller than the third diameter. The generally tapered portion also includes a tapered portion that extends from the third diameter to the fourth diameter. The pilot also includes at least one fastener relief, having a tapered portion, formed into a portion of the generally cylindrically shaped shoulder portion of the pilot. The pilot assembly includes at least one mounting fastener with a shaped washer that engages the tapered portion of the at least one fastener relief.

These and other advantages of the invention will be further understood and appreciated by those skilled in the art by reference to the following written specification, claims, and appended drawings.

DETAILED DESCRIPTION OF THE PREFERRED EMBODIMENTS

For purposes of description herein, the terms "upper," "lower," "right," "left," "rear," "front," "vertical," "horizontal" and derivatives thereof shall relate to the invention as oriented in FIGS. 1-9. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
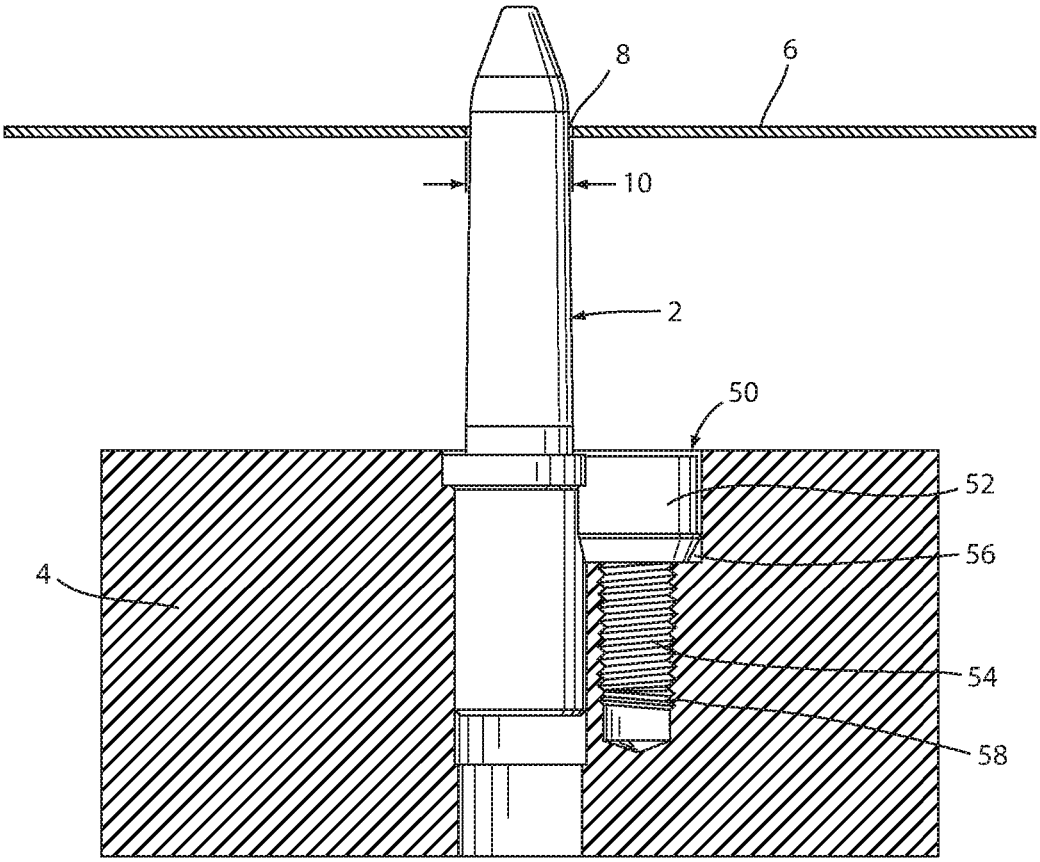
FIG. 1 is a front perspective view of a pilot assembly embodying an example of the present invention, shown installed in a die member starting to engage the pilot hole in a stock.
Figure 2:
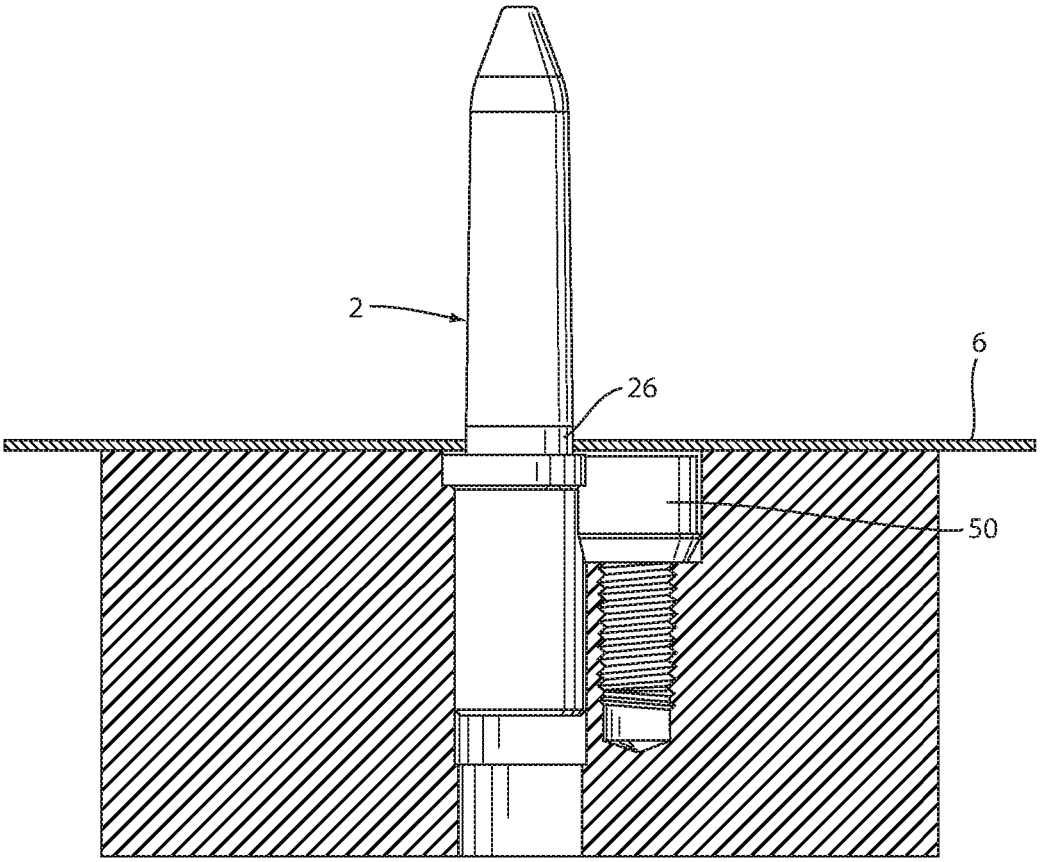
FIG. 2 is the pilot assembly shown in FIG. 1 with the stock fully engaged on the pilot assembly.

The reference numeral 2 (FIGS. 1-6) generally designates a pilot assembly embodying exemplary embodiments of the present invention. As shown in FIG. 1, the pilot assembly 2 is particularly adapted for use in conjunction with metal forming dies. FIG. 1 illustrates the installation of the pilot assembly 2 into a die member 4. The die member 4 can be one of the die members of a multi-station metal forming die with at least two mutually converging and diverging die members, or can be a transfer die that transfers a metal part between individual working stations. A transfer die may consist of a single operation die or a die set in a press. As illustrated in FIG. 1, the stock 6 includes a pilot opening 8 that has a diameter 10 that is wider than the outer end 16 of the pilot assembly 2. As illustrated in FIG. 2, the diameter 10 of the pilot opening 8 of the stock 6 will closely engage the innermost portion 26 of the outer end 16 of the pilot assembly 2.

Figure 3:
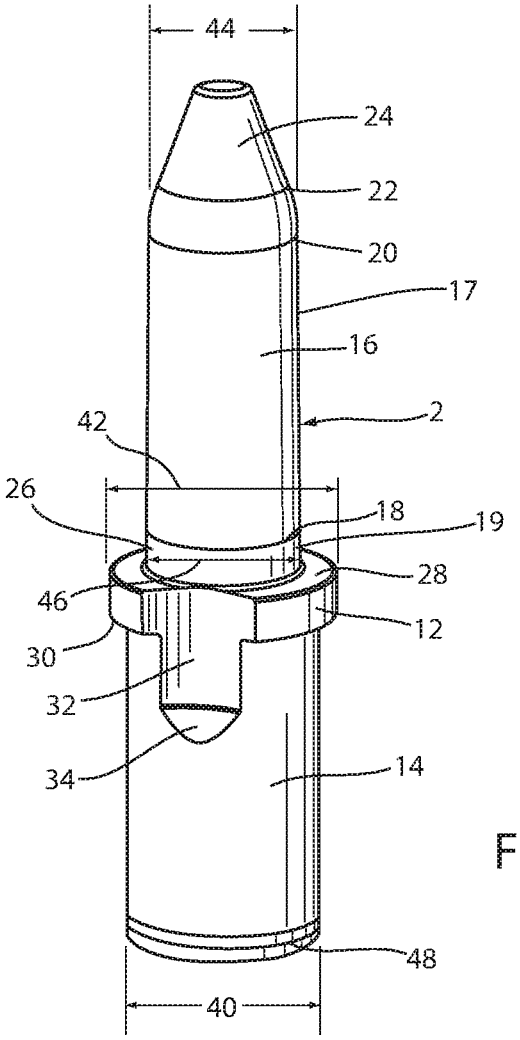
FIG. 3 is a front perspective view of the pilot shown in FIGS. 1 and 2.

The pilot assembly 2 includes an outer end 16 that will be oriented toward the stock 6, an oppositely disposed inner end 14 that will be oriented away from the stock 6, and a medial portion 12 disposed axially between the outer end 16 and the inner end 14, as illustrated in FIG. 3. The medial portion 12 has a generally cylindrical shape with a first diameter 42. The inner end 14 of the pilot assembly 2 has a generally cylindrically shaped body portion with a second diameter 40. The second diameter 40 is less than the first diameter 42 of the medial portion 12 to form a first annularly shaped, radially oriented shoulder 30 therebetween.

The outer end 16 of the pilot assembly 2 has a generally cylindrical innermost portion 26 that is disposed adjacent to the medial portion 12 of the pilot assembly 2. The generally cylindrical innermost portion 26 has a third diameter 46 that is less than the first diameter 42 thereby forming a second annularly shaped, radially oriented shoulder 28 therebetween. The outer end 16 of the pilot assembly 2 also includes a generally cylindrical portion 20 at the outermost portion of the outer end 16, having a fourth diameter 44 that is less than the third diameter 46. The outer end 16 of the pilot assembly 2 also includes a generally conically shaped outermost portion 24 that extends from the generally cylindrically shaped portion 20 having a fourth diameter 44. A curved radial portion 22 can be located between the generally conically shaped outermost portion 24 and the generally cylindrical portion 20 that has the fourth diameter 44.

Figure 7:
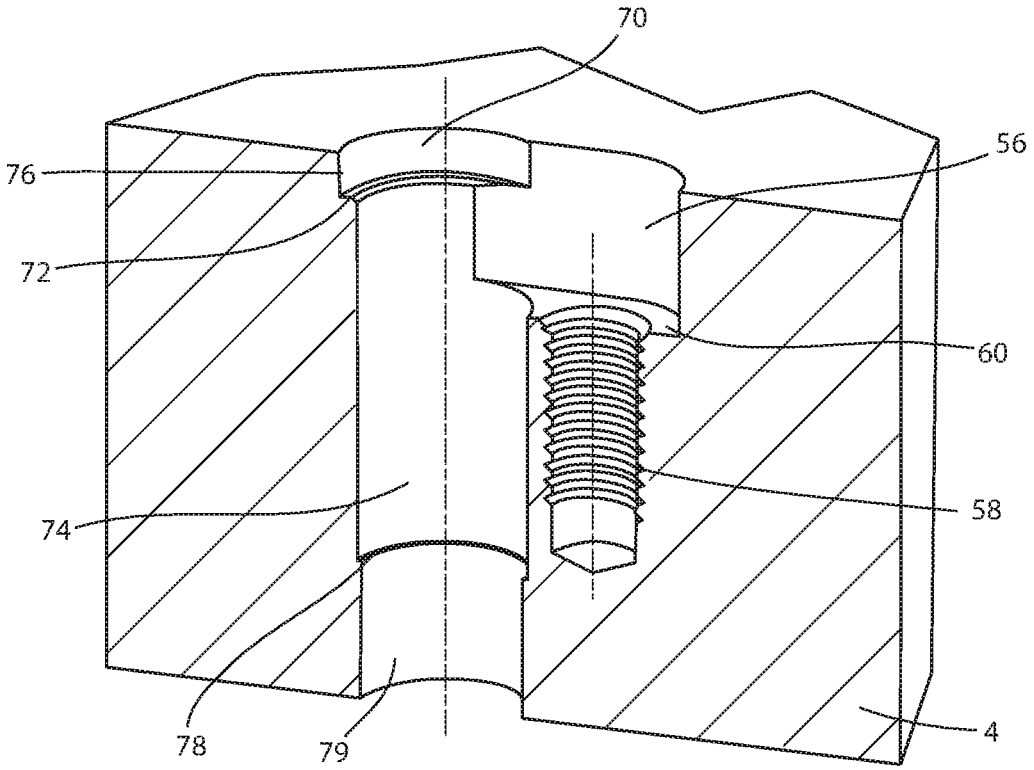
FIG. 7 is a cross-sectional view of the pilot aperture and fastener aperture for the single fastener pilot shown in FIG. 6.

As illustrated in FIG. 3, the generally cylindrical innermost portion 26 of the outer end 16 of the pilot assembly 2 can have a straight portion 19 between the second annularly shaped, radially oriented shoulder 28 and the end 18 of the generally cylindrical innermost portion 26 that has the third diameter 46. Thus, the outer end 16 of the pilot assembly 2 will have a shaped portion 17 between the end 18 of the generally cylindrical innermost portion 26 having the third diameter 46 and the generally cylindrical portion 20 having the fourth diameter 44. As illustrated in FIG. 3, the inner end 14 of the pilot assembly 2 may have additional radially oriented shoulders 48 for engaging corresponding surfaces 78 within the die member 4, as illustrated in FIG. 7.

Figure 5:
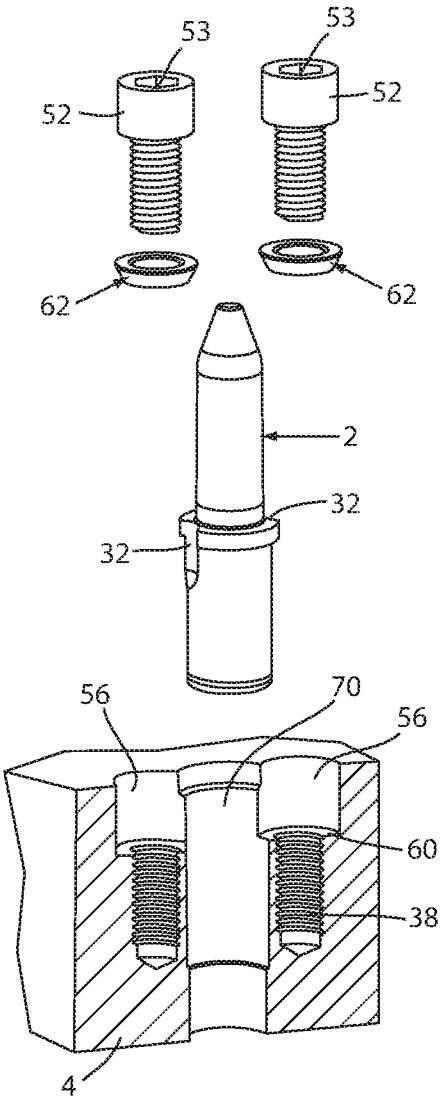
FIG. 5 is a front perspective view of a modular pilot assembly having two fastener reliefs for installation into a die member.
Figure 6:
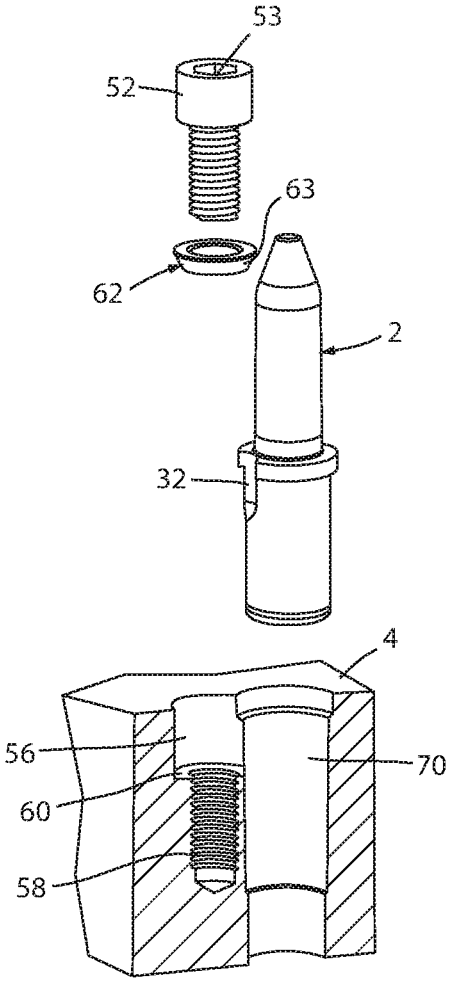
FIG. 6 is a front perspective view of a pilot assembly having a single fastener relief before installation into a die member.

At least one fastener relief 32 is formed into the pilot assembly 2. FIG. 3 illustrates an example of a single fastener relief 32 that is formed into the generally cylindrically shaped medial portion 12 that is located between the first annularly shaped shoulder 30 and the second annularly shaped shoulder 28. In addition, the fastener relief 32 extends into a portion of the inner end 14 of the pilot assembly 2. The fastener relief 32 includes a tapered portion 34, as illustrated in FIG. 3. FIG. 5 illustrates the pilot assembly 2 with two fastener reliefs 32. The pilot assembly 2 can include additional fastener reliefs 32 if deemed necessary.

At least one fastener 50 is used to secure the pilot assembly 2 to the die member 4. The fastener 50 includes an enlarged head 52 and a shank 54. As illustrated in FIG. 1, the shank 54 can be threaded. In the illustrated embodiment, the enlarged head 52 of the fastener 50 includes a hexagonal opening 53 for engaging a tool for installing and/or removing the fastener 50 from the die member.

A shaped washer 62 includes a tapered surface 63 that engages the tapered surface 34 of the fastener relief 32 when the fastener 50 is secured into the die member 4, as illustrated in FIGS. 1 and 2. While the illustrated embodiments show the shaped washer 62 as a separate piece from the fastener 50, the fastener 50 can have an integrally formed tapered surface (not shown).

In order to install the pilot assembly 2 into the die member 4, a pilot mounting aperture 70 is formed in the die member 4. The pilot mounting aperture 70 includes a larger diameter portion 76 and a smaller diameter portion 74 with an integrally formed shoulder 72 therebetween, as shown in FIG. 7. That integrally formed shoulder 72 will engage the first annularly shaped, radially oriented shoulder 30 of the pilot assembly 2, as illustrated in FIGS. 1 and 2, when the pilot assembly 2 is secured to the die member 4. The pilot mounting aperture 70 and die member 4 can further include an additional integrally formed shoulder 78 between the lower portion 79 and portion 74 to engage shoulder 48 of the pilot assembly 2.

Figure 8:
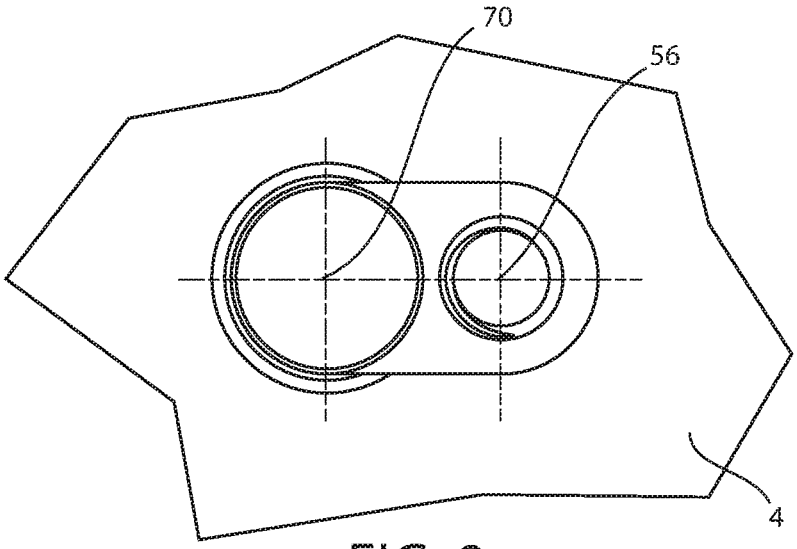
FIG. 8 is a top perspective view of the pilot and fastener apertures shown in FIG. 7 in the die member.

The die member 4 further includes a fastener aperture 56. The fastener aperture 56 includes a portion 60 shaped to receive the enlarged head 52 and the shaped washer 62. The fastener aperture 56 further includes a threaded portion 58, shaped to receive the shank portion 54 of the fastener 50, as shown in FIG. 1. As shown in FIGS. 7 and 8, the central axis of the pilot mounting aperture 70 and the central axis of the fastener aperture 56 should be generally spaced apart but in vertical alignment.

FIGS. 1-3 and 6-8 illustrate the use of a single fastener 50 with a single fastener relief 32 and a single fastener aperture 56 in the die member 4. However, as illustrated in FIG. 5, multiple fasteners 50 can be used to install the pilot assembly 2 into the die member 4 provided that the associated fastener apertures 56 are formed in the die member 4.

The illustrated pilot assembly 2 has a one-piece construction formed from a solid bar of rigid material, such as metal or the like. Thus, all machining operations on the solid bar of rigid material can be made during a single machine setup, so as to achieve greater accuracy and consistency of the pilot assembly 2, as well as reduced manufacturing costs. As illustrated in FIGS. 1 and 2, the pilot opening 8 in the stock 6, having diameter 10, will generally match the third diameter 46 of the pilot assembly 2 when the stock 6 is fully received on the pilot assembly 2, as illustrated in FIG. 2. The diameter 10 of the pilot opening 8 of the stock 6 is slightly larger than the fourth diameter 44 near the conically shaped end 24 of the pilot assembly 2, as illustrated in FIG. 1, when the stock 6 is not fully engaged on the pilot assembly 2. The conically shaped end 24 with the radial portion 22 to the tapered portion 17 permits the stock 6 to be easily transitioned to the straight portion 19 of the pilot assembly 2 when the stock 6 is received on the die member 4. The tapered portion 17 of the pilot assembly 2 also prevents binding of the stock 6 as it is removed from die member 4. Thus, while the conical shape portion 24 with the radius 22 to the tapered portion 17 of pilot assembly 2 provides a funneling effect as the stock 6 is moved toward the die member 4, the same shape of the pilot assembly 2 permits the easy removal of the stock 6 away from die member 4, thereby preventing binding of the stock 6 to the pilot assembly 2 and die member 4.

Figure 4:
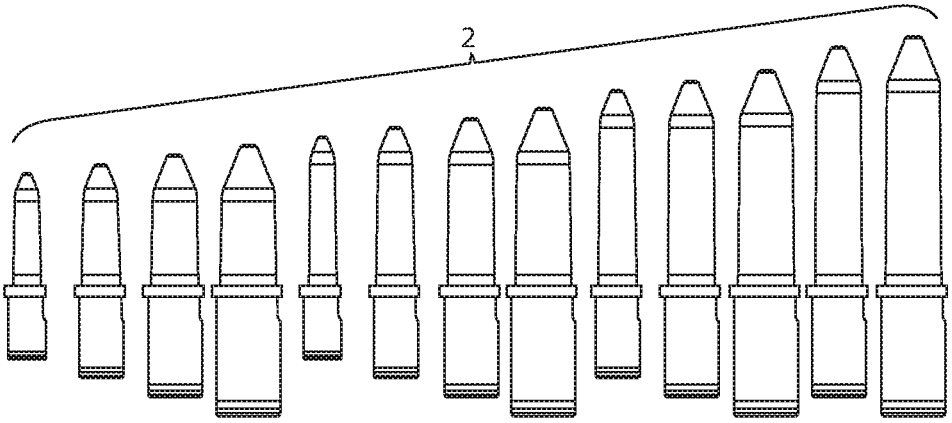
FIG. 4 is a front view of various exemplary embodiments of the pilot shown in FIG. 3 with different heights and widths.

As illustrated in FIG. 4, the pilot assembly 2 can have many different widths and lengths to accommodate various hole diameters, lengths of lift, thickness of stocks, etc. As will be appreciated by those of skill in the art, pilot assembly 2 can be provided in a wide variety of sizes to accommodate many different metal forming die applications.

Figure 9:
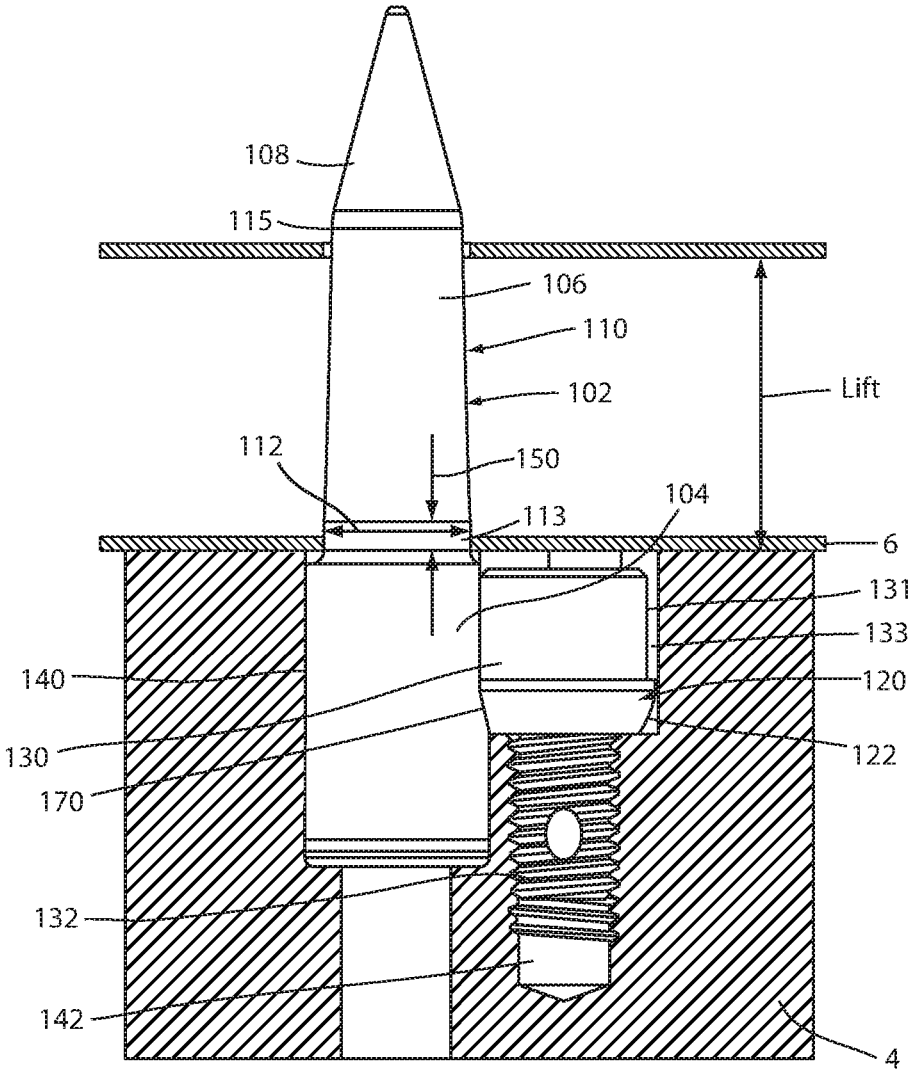
FIG. 9 is a front perspective view of another embodiment of a pilot assembly embodying an example of the present invention, shown installed in a die member.

Another embodiment of the pilot assembly 102 is illustrated in FIG. 9. This embodiment has an inner end 104 that is generally cylindrical, and an outer end 108 that comes to a point. A tapered surface 106 extends from an innermost portion 113 to an outermost portion 115. The tapered surface 106 has a taper angle 110 which is in the range of 1°-5° and more preferably about 3°. The diameter of the pilot 112 at the innermost portion 113 of the tapered surface 106 is approximately the same as or slightly larger than the diameter of the hole in the stock 6. The locating land 150 of the innermost portion 113 of the tapered surface 106 is illustrated as being larger than the thickness of the stock 6.

The pilot assembly 102 is secured to the die member 4 using a fastener 130 with an enlarged head 131 and a shank portion 132. The die member 4 has a pilot aperture 140 that closely receives the inner end 104 of the pilot assembly 102. The die member 4 also has a fastener aperture 133 that receives the fastener and the shaped washer 120. The shaped washer 120 has a shaped surface 122 that can be of any shape that abuts a corresponding shaped fastener surface 170 on the inner end 104 of the pilot assembly 102. In the illustrated example, the shaped fastener surface 170 and the shaped surface 122 of the shaped washer 120 have curved surfaces that abut each other. However, the shaped surface 122 of the shaped washer 120 and the shaped fastener surface 170 could have other shapes that engage each other to secure the pilot assembly 102 when the fastener 130 is installed in the die member 4. Alternatively, the shaped surface could be formed on the fastener 130 directly to engage the shaped fastener surface 170 when a washer is not used.

As illustrated in FIGS. 1, 2, and 5-9, the machining required to mount the pilot assembly 2, 102 and the die member 4 is simple, and the mounting of the pilot assembly 2, 102 is done from the working side of the die member 4 therefore not requiring access to the non-working side of the die member 4 or machining from the non-working side of the die member 4. Thus, once the machining is complete, the pilot assembly 2 can be easily installed into and easily removed from associated die member 4.

In the foregoing description, it will be readily appreciated by those skilled in the art that modifications may be made to the invention without departing from the concepts disclosed herein. Such modifications are to be considered as included in the following claims, unless these claims by their language expressly state otherwise.

It will be understood by one having ordinary skill in the art that construction of the present disclosure and other components is not limited to any specific material. Other exemplary embodiments of the disclosure disclosed herein may be formed from a wide variety of materials, unless described otherwise herein.

For purposes of this disclosure, the term "coupled" or "operably coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

For purposes of this disclosure, the term "connected" or "operably connected" (in all of its forms, connect, connecting, connected, etc.) generally means that one component functions with respect to another component, even if there are other components located between the first and second component, and the term "operable" defines a functional relationship between components.

It is also important to note that the construction and arrangement of the elements of the present disclosure as shown in the exemplary embodiments is illustrative only. Although only a few embodiments of the present innovations have been described in detail in this disclosure, those skilled in the art who review this disclosure will readily appreciate that, unless otherwise described, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating positions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

The invention claimed is as follows:

1. A multi-station metal forming die having at least two mutually converging and diverging die members between which an elongate stock is shifted longitudinally to form parts from the stock, the improvement of a pilot assembly, comprising:

a pilot operably supported on one of said die members and having an outer end oriented toward the stock, an oppositely disposed inner end oriented away from the stock, and a medial portion disposed axially between said outer and inner ends, and including:

a generally cylindrically shaped shoulder portion disposed at said medial portion, having a first diameter;

a generally cylindrically shaped body portion disposed at said inner end having a second diameter that is less than said first diameter of said shoulder portion to define a first annularly shaped, radially oriented shoulder therebetween;

a generally tapered transition portion disposed at said outer end, including:

a generally cylindrical innermost portion disposed adjacent to said generally cylindrically shaped shoulder portion with a third diameter that is less than said first diameter of said shoulder portion to define a second annularly shaped, radially oriented shoulder therebetween for securing said pilot in an associated pilot mounting aperture in said one die member;

a generally conically shaped outermost portion extending from a generally cylindrical portion having a fourth diameter which is smaller than said third diameter; and a shaped portion extending from said generally cylindrical portion with said third diameter to said generally cylindrical portion with said fourth diameter;

at least one fastener relief formed into a portion of said generally cylindrically shaped shoulder portion; and at least one mounting fastener having an enlarged head portion that is at least partially received in said fastener relief and a shank portion anchored in said one die member to securely mount said pilot on said one die member.

2. The metal forming die as set forth in claim 1, wherein at least a portion of at least one fastener relief is formed into a portion of said generally cylindrically shaped body portion.

3. The metal forming die as set forth in claim 1, wherein said at least one fastener relief is two fastener reliefs that are formed on opposite sides of said generally cylindrically shaped shoulder portion.

4. The metal forming die as set forth in claim 1, wherein said pilot mounting aperture in said one die member includes a surface that engages said first annularly shaped, radially oriented shoulder located between said shoulder portion and said body portion of said pilot.

5. The metal forming die as set forth in claim 1, wherein said generally cylindrical innermost portion of said tapered transition portion includes a straight section between said second annularly shaped, radially oriented shoulder and the beginning of said shaped portion.

6. The metal forming die as set forth in claim 1, wherein said generally tapered transition portion includes a curved section located between said fourth diameter and said generally conically shaped outermost portion.

7. The metal forming die as set forth in claim 1, including a shaped washer disposed on said at least one mounting fastener that engages a shaped portion of said at least one fastener relief.

8. The metal forming die as set forth in claim 7, wherein said shaped portion of said at least one fastener relief is located on said generally cylindrically shaped body portion.

9. The metal forming die as set forth in claim 1, wherein the shank portion of said at least one mounting fastener is threaded.

10. A pilot assembly for a metal forming die in which stock is formed into at least one part, comprising:

a pilot operably supported on a metal forming die, having an outer end oriented toward the stock and an oppositely disposed inner end oriented away from the stock and a medial portion disposed axially between said outer and inner ends, and including:

a generally cylindrically shaped shoulder portion disposed at said medial portion, having a first diameter;

a generally cylindrically shaped body portion disposed at said inner end having a second diameter that is less than said first diameter of said shoulder portion to define a first annularly shaped, radially oriented shoulder therebetween;

a generally tapered transition portion disposed at said outer end, including:

a generally cylindrical innermost portion disposed adjacent to said generally cylindrically shaped shoulder portion with a third diameter that is less than said first diameter of said shoulder portion to define a second annularly shaped, radially oriented shoulder therebetween for securing said pilot in an associated pilot mounting aperture in said one die member;

a generally conically shaped outermost portion extending from a generally cylindrical portion having a fourth diameter which is smaller than said third diameter; and a shaped portion extending from said generally cylindrical portion with said third diameter to said generally cylindrical portion with said fourth diameter;

at least one shaped fastener relief formed into a portion of said generally cylindrically shaped body portion;

at least one mounting fastener having an enlarged head portion that is anchored in said one die member to securely mount said pilot on said one die member; and at least one shaped washer that is received on said at least one mounting fastener, with a shaped surface that engages at least a portion of said shaped fastener relief.

11. The metal forming die as set forth in claim 10, wherein the shaped surface of said shaped washer is curved.

12. The metal forming die as set forth in claim 10, wherein said at least one shaped fastener relief is two fastener reliefs that are formed on opposite sides of said generally cylindrically shaped body portion.

13. The metal forming die as set forth in claim 10, wherein said generally cylindrical innermost portion of said generally tapered transition portion includes a straight section before said tapered transition portion.

14. The metal forming die as set forth in claim 11, wherein the at least one shaped fastener relief includes a curved portion.

15. A pilot assembly for engaging a hole in a stock, comprising:

a pilot having an outer end oriented toward the stock, an oppositely disposed inner end oriented away from the stock, and a medial portion disposed axially between said outer and inner ends, and including:

a generally cylindrically shaped shoulder portion disposed at said medial portion, having a first diameter, a generally cylindrically shaped body portion disposed at said inner end having a second diameter that is less than said first diameter of said shoulder portion to define a first annularly shaped, radially oriented shoulder therebetween;

a generally tapered transition portion disposed at said outer end, including:

a generally cylindrical innermost portion disposed adjacent to said generally cylindrically shaped shoulder portion with a third diameter that is less than said first diameter of said shoulder portion to define a second annularly shaped, radially oriented shoulder therebetween;

a generally conically shaped outermost portion extending from a generally cylindrical portion having a fourth diameter which is smaller than said third diameter; and a shaped portion extending from said generally cylindrical portion with said third diameter to said generally cylindrical portion with said fourth diameter;

at least one fastener relief having a shaped portion formed into a portion of said generally cylindrically shaped shoulder portion; and at least one mounting fastener with a shaped washer that engages said shaped portion of said at least one fastener relief.

16. The metal forming die as set forth in claim 15, wherein at least a portion of at least one fastener relief is formed into a portion of said generally cylindrically shaped body portion.

17. The metal forming die as set forth in claim 15, wherein said at least one fastener relief is two fastener reliefs that are formed on opposite sides of said generally cylindrically shaped shoulder portion.

18. The metal forming die as set forth in claim 15, wherein said generally cylindrical innermost portion of said tapered transition portion includes a straight section between said second annularly shaped, radially oriented shoulder and the beginning of said shaped portion.

19. The metal forming die as set forth in claim 15, wherein said generally tapered transition portion includes a curved section located between said fourth diameter and said generally conically shaped outermost portion.

20. The metal forming die as set forth in claim 15, wherein said pilot is a single piece of material.

* * * * *